US009031475B2

(12) United States Patent
Shirakata et al.

(10) Patent No.: US 9,031,475 B2
(45) Date of Patent: May 12, 2015

(54) DEVELOPER CONTAINING CHAMBER, DEVELOPING DEVICE, PROCESS CARTRIDGE, AND IMAGE FORMING APPARATUS

(71) Applicant: Canon Kabushiki Kaisha, Tokyo (JP)

(72) Inventors: Sho Shirakata, Kawasaki (JP); Tachio Kawai, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 134 days.

(21) Appl. No.: 13/707,238

(22) Filed: Dec. 6, 2012

(65) Prior Publication Data

US 2013/0149010 A1 Jun. 13, 2013

(30) Foreign Application Priority Data

Dec. 8, 2011 (WO) ..... PCT/JP2011/078436

(51) Int. Cl.
*G03G 15/08* (2006.01)
*G03G 21/18* (2006.01)

(52) U.S. Cl.
CPC ..... *G03G 21/18* (2013.01); *G03G 15/0877* (2013.01); *G03G 21/1814* (2013.01)

(58) Field of Classification Search
USPC ..... 399/262, 263, 253, 258, 120
See application file for complete search history.

(56) References Cited

U.S. PATENT DOCUMENTS

2007/0264051 A1* 11/2007 Tanaka ..... 399/254
2008/0279594 A1* 11/2008 Sakoh et al. ..... 399/262
2011/0103846 A1* 5/2011 Ota ..... 399/263

FOREIGN PATENT DOCUMENTS

JP 02-285374 A 11/1990
JP 2002-040788 A 2/2002
JP 2005-070363 A 3/2005
JP 2007-304281 A 11/2007

* cited by examiner

*Primary Examiner* — Roy Y Yi
(74) *Attorney, Agent, or Firm* — Canon USA Inc IP Division

(57) ABSTRACT

An object is to smoothly convey toner from a developer containing chamber to a developing chamber even when an opening that provides communication between the developer containing chamber and the developing chamber has a connecting part for adding strength to the apparatus. A sheet member that conveys a developer from an opening to the outside of a developer containing chamber has an entering portion that is formed by a first slit extending from a free end of the sheet member and positioned to cross a connecting part as viewed in a direction orthogonal to a longitudinal direction of a shaft member. The entering portion is configured to enter the outside of the developer containing chamber from the inside of the developer containing chamber. The entering portion overlaps in position with the connecting part as viewed in the direction orthogonal to the longitudinal direction of the shaft member.

16 Claims, 14 Drawing Sheets

DEVELOPER CONTAINING CHAMBER, DEVELOPING DEVICE, PROCESS CARTRIDGE, AND IMAGE FORMING APPARATUS

TECHNICAL FIELD

The present disclosure relates to an image forming apparatus and a developer containing chamber, a developing device, and a process cartridge used in the image forming apparatus.

The image forming apparatus is an apparatus that forms an image on a recording medium. Examples of the image forming apparatus include electrophotographic copiers, electrophotographic printers (e.g., LED printers and laser beam printers), and electrophotographic facsimiles using an electrophotographic image forming process.

The developer containing chamber is a chamber that contains developer. The developing device includes a developer bearing member and the developer containing chamber. The process cartridge is formed by integrating an image bearing member and the developer bearing member into a single unit, which can be attached to and removed from a main body of the image forming apparatus.

BACKGROUND ART

Conventionally, a cartridge method has been used in an image forming apparatus that performs an electrophotographic image forming process. In the cartridge method, an image bearing member and a process means that acts on the image bearing member are integrated into a cartridge, which can be attached to and removed from the image forming apparatus. The cartridge method is very user friendly in that users can perform maintenance on the apparatus without relying on service persons. The cartridge method has been widely used in image forming apparatuses.

Conventionally, a process cartridge has included a developing device that develops an electrostatic latent image on an image bearing member with developer. The developing device includes a developing chamber internally provided with a developer bearing member, and a developer containing chamber configured to contain developer. The developing chamber and the developer containing chamber have an opening (developing opening) therebetween, which allows developer to pass therethrough. An agitating means supplies developer from the developer containing chamber to the developing chamber.

The agitating means includes a shaft member rotatably provided in the developer containing chamber, and an elastic sheet secured to the shaft member. A configuration is known in which, in order for the agitating means to smoothly supply developer to the developing chamber and loosen dense developer in the developing chamber, a leading edge of the elastic sheet enters the developing chamber from the developer containing chamber (see Patent Literature (PTL) 1).

Since the developing device has the developing opening which serves as a path of the developer, the strength of the developing device may be degraded. For adding strength to the developing device, two opposite sides of the developing opening extending in the axial direction of the developer bearing member may be partially connected to each other by a connecting part, such as a rib.

However, the connecting part hinders the leading edge of the elastic sheet from entering the developing chamber. To solve this problem, the elastic sheet may have a notched portion at a position facing the connecting part so as to avoid contact with the connecting part (see PTL 2). With this configuration, however, the developer around the connecting part may not be able to be conveyed to the developing chamber, or the developer on the back side of the connecting part may not be able to be loosened.

There is a configuration in which the developing chamber also includes an agitating means. This configuration, which requires a total of two agitating means, may cause an increase in cost and size of the apparatus (see PTL 3).

CITATION LIST

Patent Literature

PTL 1 Japanese Patent Laid-Open No. 2005-070363
PTL 2 Japanese Patent Laid-Open No. 2002-040788
PTL 3 Japanese Patent Laid-Open No. 02-285374

The present disclosure has been made to solve the problems with the prior art described above. An object of the present disclosure is to smoothly convey toner from a developer containing chamber to a developing chamber even when an opening that provides communication between the developer containing chamber and the developing chamber has a connecting part for adding strength to the apparatus.

SUMMARY OF INVENTION

A typical configuration of the present disclosure for achieving the object described above is characterized in that a developer containing chamber that contains a developer includes an opening configured for the developer to pass therethrough; a shaft member rotatably supported inside the developer containing chamber; a sheet member secured to the shaft member and configured to convey the developer from the opening to the outside of the developer containing chamber when the shaft member rotates; and a connecting part configured to connect one end to another end of the opening in a direction orthogonal to a longitudinal direction of the shaft member, wherein the sheet member has an entering portion formed by a first slit extending from a free end of the sheet member and positioned to cross the connecting part as viewed in the direction orthogonal to the longitudinal direction, the entering portion configured to enter the outside of the developer containing chamber from the inside of the developer containing chamber, the entering portion configured to overlap in position with the connecting part as viewed in the direction orthogonal to the longitudinal direction of the shaft member.

Another configuration of the present disclosure is characterized in that a developing device that develops a latent image formed on an image bearing member includes a developer bearing member configured to bear a developer; a developing chamber configured to include the developer bearing member; a developer containing chamber configured to contain the developer; an opening configured to provide communication between the developing chamber and the developer containing chamber; a shaft member rotatably supported inside the developer containing chamber; a sheet member secured to the shaft member and configured to convey the developer from the developer containing chamber to the developing chamber when the shaft member rotates; and a connecting part configured to connect one end to another end of the opening in a direction orthogonal to a longitudinal direction of the shaft member, wherein the sheet member has an entering portion formed by a first slit extending from a free end of the sheet member and positioned to cross the connecting part as viewed in the direction orthogonal to the longitudinal direction, the entering portion configured to enter the developing chamber from the developer containing chamber, the entering portion configured to overlap in position with the connecting part as viewed in the direction orthogonal to the longitudinal direction of the shaft member.

Another configuration of the present disclosure is characterized in that a process cartridge to be attached to, or removed from, an image forming apparatus main body includes an image bearing member on which a latent image is formed; a developer bearing member configured to bear a developer for developing the latent image; a developing chamber configured to include the developer bearing member; a developer containing chamber configured to contain the developer; an opening configured to provide communication between the developing chamber and the developer containing chamber; a shaft member rotatably supported inside the developer containing chamber; a sheet member secured to the shaft member and configured to convey the developer from the developer containing chamber to the developing chamber when the shaft member rotates; and a connecting part configured to connect one end to another end of the opening in a direction orthogonal to a longitudinal direction of the shaft member, wherein the sheet member has an entering portion formed by a first slit extending from a free end of the sheet member and positioned to cross the connecting part as viewed in the direction orthogonal to the longitudinal direction, the entering portion configured to enter the developing chamber from the developer containing chamber, the entering portion configured to overlap in position with the connecting part as viewed in the direction orthogonal to the longitudinal direction of the shaft member.

Another configuration of the present disclosure is characterized in that an image forming apparatus that forms an image on a recording medium includes conveying means for conveying the recording medium; an image bearing member on which a latent image is formed; a developer bearing member configured to bear a developer for developing the latent image; a developing chamber configured to include the developer bearing member; a developer containing chamber configured to contain the developer; an opening configured to provide communication between the developing chamber and the developer containing chamber; a shaft member rotatably supported inside the developer containing chamber; a sheet member secured to the shaft member and configured to convey the developer from the developer containing chamber to the developing chamber when the shaft member rotates; and a connecting part configured to connect one end to another end of the opening in a direction orthogonal to a longitudinal direction of the shaft member, wherein the sheet member has an entering portion formed by a first slit extending from a free end of the sheet member and positioned to cross the connecting part as viewed in the direction orthogonal to the longitudinal direction, the entering portion configured to enter the developing chamber from the developer containing chamber, the entering portion configured to overlap in position with the connecting part as viewed in the direction orthogonal to the longitudinal direction of the shaft member.

Further features will become apparent from the following description of exemplary embodiments with reference to the attached drawings.

DESCRIPTION OF EMBODIMENTS

First Embodiment

A developing device, a process cartridge, and an image forming apparatus according to the present disclosure will now be described with reference to the drawings.

In the following description, a longitudinal direction of the process cartridge will be simply referred to as a longitudinal direction. The longitudinal direction coincides with a longitudinal direction (or axial direction) of an image bearing member (or photosensitive drum). A lateral direction of the process cartridge will be simply referred to as a lateral direction. The lateral direction is orthogonal to the rotational axis of the image bearing member and coincides with a conveying direction in which a recording medium is conveyed. For the process cartridge, upper and lower directions refer to those of the process cartridge attached to a main body of the image forming apparatus.

(Overall Configuration of Image Forming Apparatus)

Figure 2:
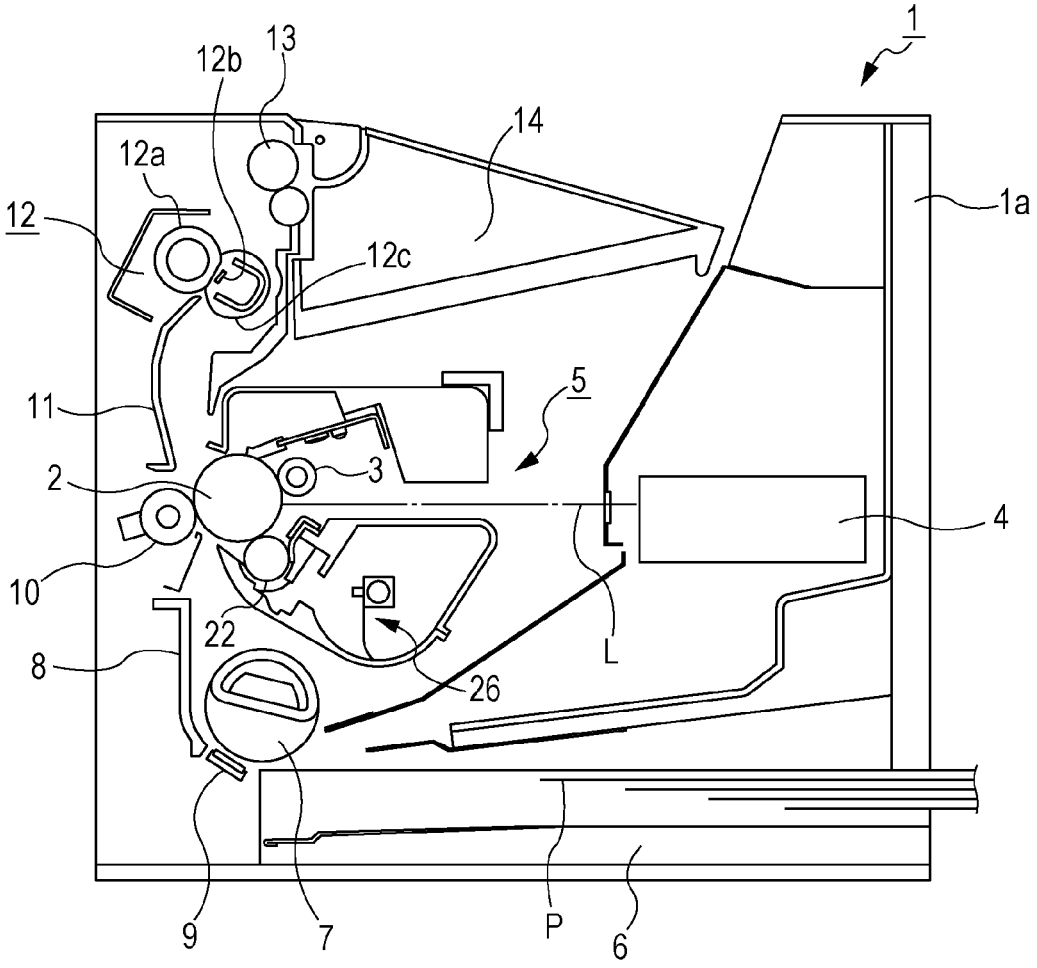
FIG. 2 is an overall schematic view of an image forming apparatus according to the first embodiment.

With reference to FIG. 2, an overall configuration of an image forming apparatus according to the present embodiment will be described. A laser beam printer 1 illustrated in FIG. 2 is an image forming apparatus that forms an image on a recording medium P (e.g., recording paper, OHP sheet, or fabric) with developer in an electrophotographic image forming process. The laser beam printer (hereinafter referred to as an image forming apparatus) 1 forms an image in accordance with image information from an external device, such as a personal computer, connected to an image forming apparatus main body 1*a* so as to be able to communicate therewith.

A surface of a drum-shaped image bearing member (hereinafter referred to as a "photosensitive drum") 2 is uniformly charged by a charging roller 3 serving as a charging means. An optical means (exposure means) 4 irradiates the photosensitive drum 2 with laser light L corresponding to image information to form an electrostatic latent image in accordance with the image information on the photosensitive drum 2. A developing means (described below) develops the electrostatic latent image on the photosensitive drum 2 with toner, which is developer, to form a toner image.

In synchronization with formation of the toner image, the recording media P loaded in a feeding cassette 6 are separated and fed one by one by a pickup roller 7 and a press-contact member 9 pressed into contact with the pickup roller 7. Each recording medium P is conveyed along a conveying guide 8 to a transfer roller 10 serving as a transfer means. The recording medium P then passes through a transfer nip portion formed by the photosensitive drum 2 and the transfer roller 10 to which a constant voltage is applied. The toner image formed on the photosensitive drum 2 is transferred to the recording medium P at this point. The recording medium P having the toner image transferred thereto is conveyed by a conveying guide 11 to a fixing means 12.

The fixing means 12 includes a driving roller 12*a* and a fixing roller 12*c* that includes a heater 12*b*. The fixing means 12 applies heat and pressure to the recording medium P passing through a nip portion formed by the fixing roller 12*c* and the driving roller 12*a*, so as to fix the transferred toner image onto the recording medium P. Then, the recording medium P is conveyed by a discharge roller pair 13 and discharged onto an output tray 14. Note that the pickup roller 7, the press-contact member 9, the conveying guide 8, and the discharge roller pair 13 form a conveying means that conveys recording media inside the laser beam printer 1.

(Process Cartridge)

A process cartridge 5 that can be attached to and removed from an image forming apparatus main body of the present embodiment will now be described with reference to FIG. 3.

Figure 3:
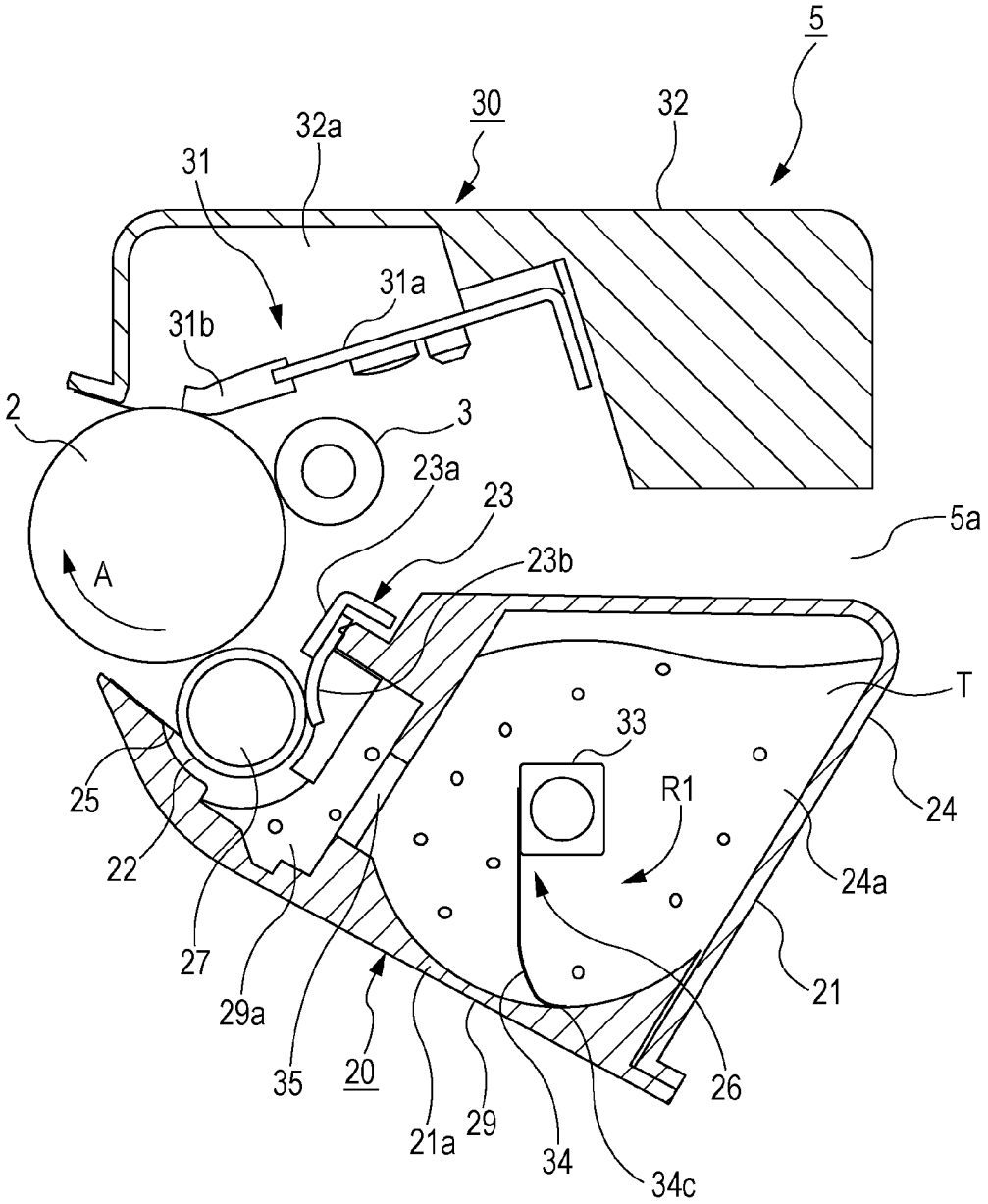
FIG. 3 is a vertical cross-sectional view of a process cartridge according to the first embodiment.

In FIG. 3, a developing means (hereinafter referred to as a "developing device") 20 includes a developer container (hereinafter referred to as a "toner container") 21 that contains magnetic single-component developer (toner) T composed substantially only of magnetic resin toner particles (which may contain external additives) in the present embodiment.

The developing device 20 includes a developing roller 22 serving as a developer bearing member, and a developer-layer-thickness regulating means (hereinafter referred to as a "regulating member") 23 that forms a toner layer on the surface of the developing roller 22.

The developing roller 22 is a roller that includes a stationary magnet 27. The developing roller 22 bears the toner T on its surface and supplies the toner T to the electrostatic latent image on the photosensitive drum 2 to form a visible image.

The regulating member 23 is formed by a blade support 23*a* and a developing blade 23*b* integrally molded with or bonded to the blade support 23*a*. The regulating member 23 charges the toner T on the developing roller, and regulates the thickness of the toner layer on the developing roller 22 to a constant level.

By rotation of an agitating means 26 in the direction of arrow R1, the toner T in the toner container 21 is fed to the developing roller 22 through a developing opening 35 serving as a path of the toner T.

The rotating developing roller 22 and the developing blade 23*b* of the regulating member 23 applies frictional charge to the toner T. At the same time, a toner layer having a uniform thickness is formed on the surface of the developing roller 22.

To maintain a constant clearance with respect to the photosensitive drum 2, the developing roller 22 has spacer rollers (not shown) which serve as clearance retaining members rotatably supported at both ends thereof. The developing roller 22 is pressed against the photosensitive drum 2 by a biasing spring (not shown). Thus, the toner layer formed on the surface of the developing roller 22 is supplied to a developing region of the photosensitive drum 2.

A toner image is formed by transferring the toner T to the photosensitive drum 2 in accordance with the electrostatic latent image formed on the photosensitive drum 2.

A developing frame 24 that supports the developing roller 22 and the regulating member 23 is secured to a developer container lid (hereinafter referred to as a "toner container lid") 29 by ultrasonic welding or the like to form the toner container 21. The toner container 21 has a developer containing chamber 24*a* and a developing chamber 29*a*.

The developer containing chamber 24*a* is mainly formed by the developing frame 24 and contains toner. The agitating means 26 is disposed inside the developer containing chamber 24*a*. The agitating means 26 conveys toner from the developer containing chamber 24*a* to the developing chamber 29*a*.

The developing chamber 29*a* is mainly formed by the toner container lid 29. The developing roller 22 is disposed inside the developing chamber 29*a*. A sheet member (blow-off preventing sheet) 25 is provided between the developing roller 22 and the toner container lid 29 for closing a gap therebetween. The blow-off preventing sheet 25 prevents toner from leaking through the gap.

A photosensitive unit 30 includes the photosensitive drum 2 for forming an electrostatic latent image thereon, the charging roller 3, and a cleaning means 31 that are disposed on a drum frame 32 that forms a waste toner container 32*a*. The charging roller 3 is a charging means for uniformly charging the surface of the photosensitive layer. The cleaning means 31 scrapes off residual toner adhering to the surface of the photosensitive drum 2 without being transferred to the recording medium P.

The photosensitive drum 2 is driven to rotate in the direction of arrow A. A constant voltage is applied to the charging roller 3, which is in contact with the photosensitive drum 2 and uniformly charges the surface of the photosensitive layer of the photosensitive drum 2.

The exposure means 4 (see FIG. 2) irradiates the photosensitive drum 2 with laser light through an exposure opening 5*a*, in accordance with image information, to form an electrostatic latent image on the photosensitive drum 2. Then, the developing roller 22 forms a toner image on the photosensitive drum 2.

After a voltage having a polarity opposite that of the toner image on the photosensitive drum 2 is applied to the transfer roller (transfer means) 10 (see FIG. 2) in the image forming apparatus main body 1*a* so as to transfer the toner image onto the recording medium P, the cleaning means 31 removes the residual toner on the photosensitive drum 2.

The cleaning means 31 is composed of a blade support 31*a* and a cleaning member (hereinafter referred to as a "cleaning blade") 31*b* integrally molded with or bonded to the blade support 31*a*. The cleaning blade 31*b* is brought into contact with the photosensitive drum 2. Thus, the toner T remaining on the photosensitive drum 2 is scraped off and collected in the waste toner container 32*a*.

As illustrated in FIG. 2, the process cartridge 5 is removably attached to the image forming apparatus main body 1*a*.

When the process cartridge 5 is properly attached to the image forming apparatus main body 1*a*, a contact point (not shown) of the image forming apparatus main body is electrically connected to a contact point (not shown) of the process cartridge. Then, a voltage applying means (not shown) of the image forming apparatus main body 1*a* becomes ready to apply a predetermined charging bias and a predetermined developing bias to the charging roller 3 and the developing roller 22, respectively.

Similarly, when the process cartridge 5 is properly attached to the image forming apparatus main body 1*a*, a drive transmitting unit (not shown) of the image forming apparatus main body is connected to a drive transmitting unit (not shown) of the process cartridge. Then, a driving means (not shown), such as a driving motor, of the image forming apparatus main body 1*a* becomes ready to transmit a driving force to the process cartridge 5.

In the present embodiment, the drive of the driving motor of the image forming apparatus main body 1*a* is transmitted to the photosensitive drum 2. This driving force is transmitted through the drive transmitting unit, such as a gear train, to the developing roller 22 and the agitating means 26.

The image forming apparatus main body 1*a* may include a plurality of independent driving means that independently drive the developing roller 22 and the agitating means 26, which are components of the process cartridge 5.

(Agitating Means)

The agitating means 26 will be further described. As illustrated in FIG. 3, the agitating means 26 is composed of a shaft member 33 rotatably supported by the developer containing chamber 24*a* and an elastic sheet 34. The elastic sheet 34 is a flexible sheet member secured at one end to the shaft member 33. The longitudinal direction of the shaft member 33 coincides with that of the process cartridge 5.

In the present embodiment, the length of the elastic sheet 34 is set such that, during rotation of the shaft member 33, the travel path of a free end (hereinafter referred to as an "elastic-sheet leading edge") 34*c* of the elastic sheet 34 coincides with a bottom 21*a* of the toner container 21 and the elastic-sheet leading edge 34*c* can enter the developing chamber 29*a*. When the elastic sheet 34 is located in the lower part of the toner container 21, the elastic sheet 34 is in contact with the bottom 21*a* of the toner container 21. As the agitating means 26 rotates, the elastic sheet 34 in a bent state agitates toner accumulated in the toner container 21. When the shaft member 33 further rotates to allow the elastic sheet 34 to reach the developing opening 35, the bend of the elastic sheet 34 is released and the elastic-sheet leading edge 34*c* enters the developing chamber 29*a*.

(Developing Opening and Elastic Sheet)

The configuration and behavior of the developing opening 35 and the elastic sheet 34, which are features of the present disclosure, will be described with reference to FIG. 1 and FIG. 4 to FIG. 7B.

Figure 4:
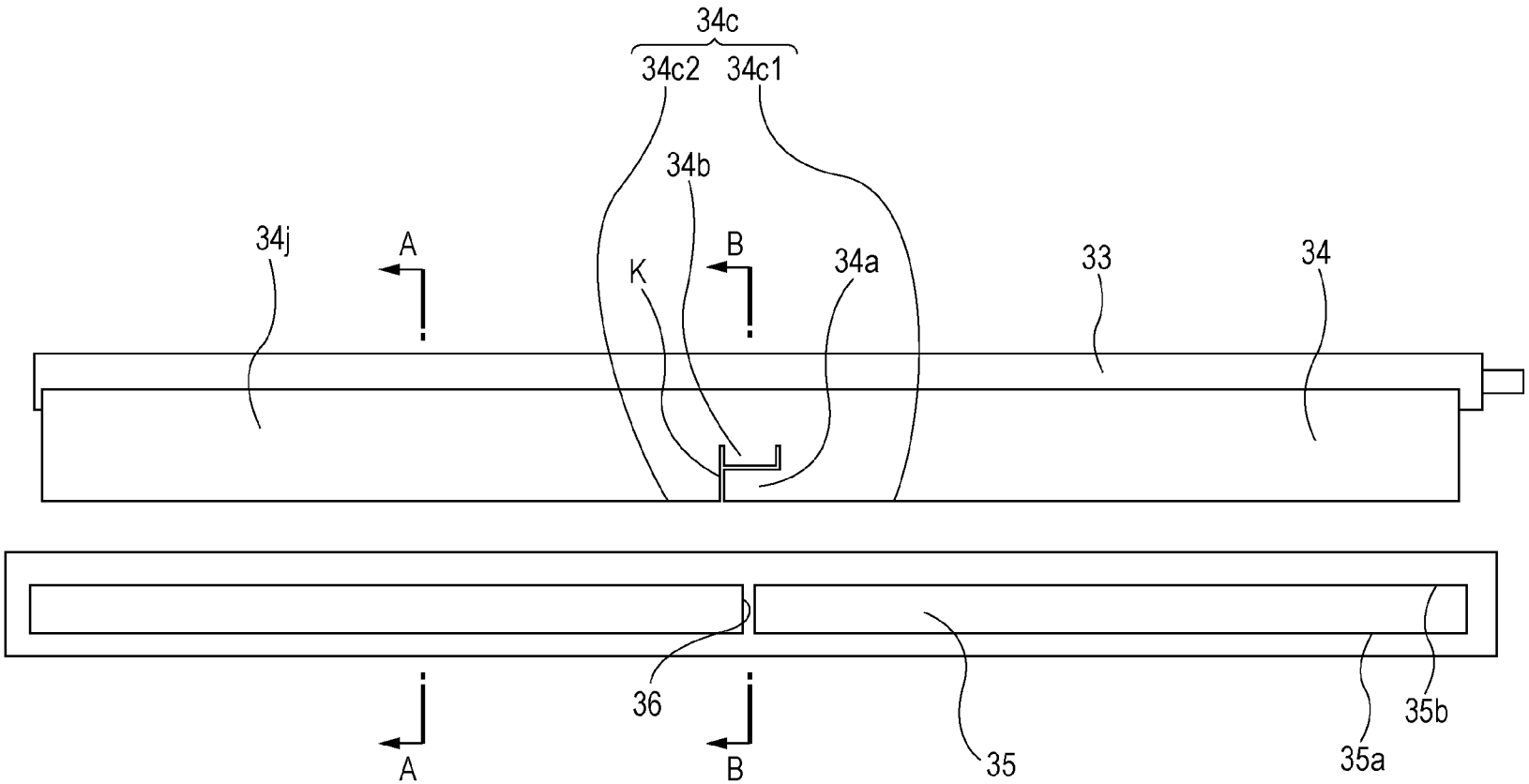
FIG. 4 is a schematic view of a developing opening and an elastic sheet according to the first embodiment.
Figure 5A:
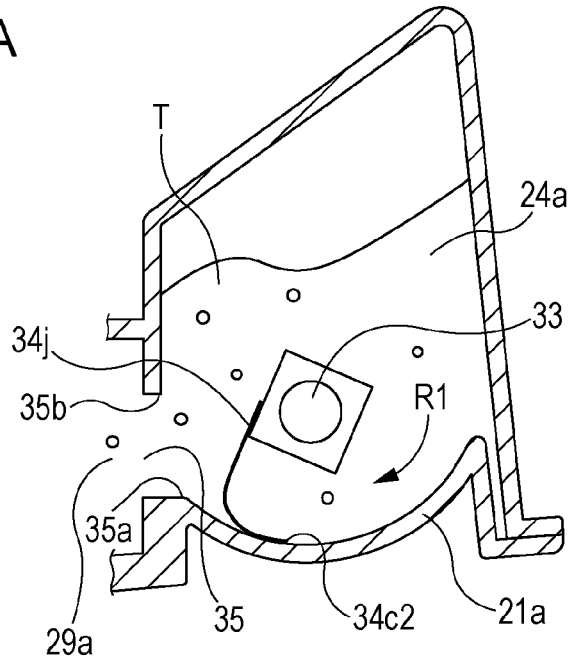
FIG. 5A is a vertical cross-sectional view illustrating a behavior of a first conveying portion according to the first embodiment.
Figure 5B:
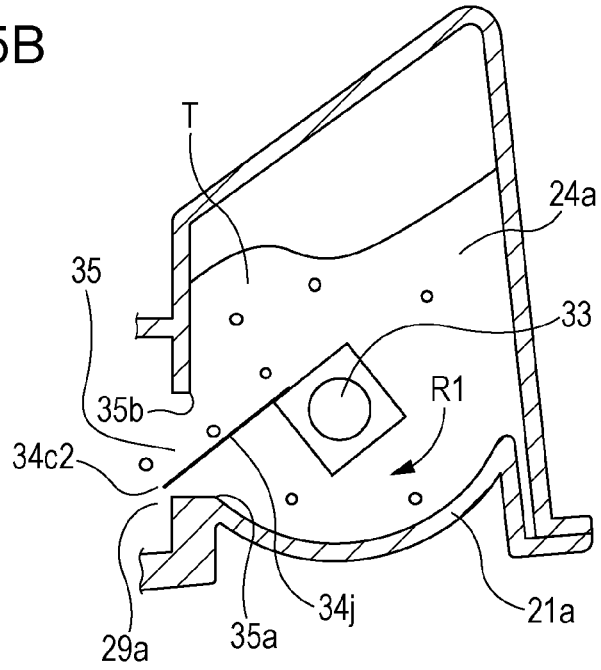
FIG. 5B is a vertical cross-sectional view illustrating a behavior of the first conveying portion according to the first embodiment.
Figure 5C:
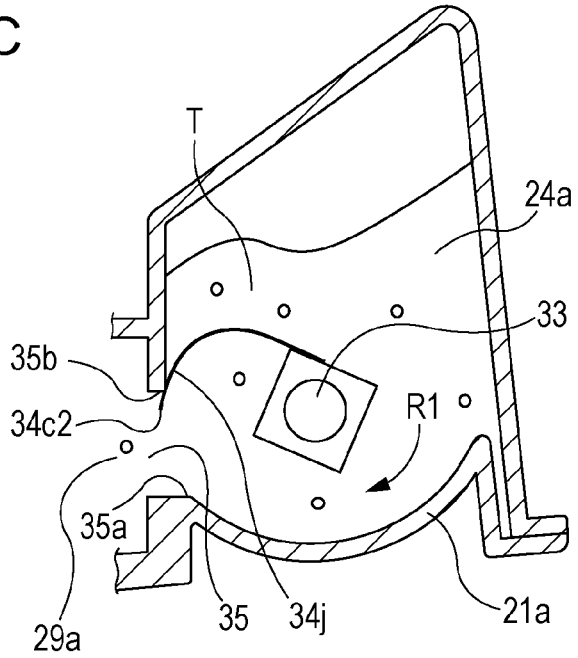
FIG. 5C is a vertical cross-sectional view illustrating a behavior of the first conveying portion according to the first embodiment.
Figure 5D:
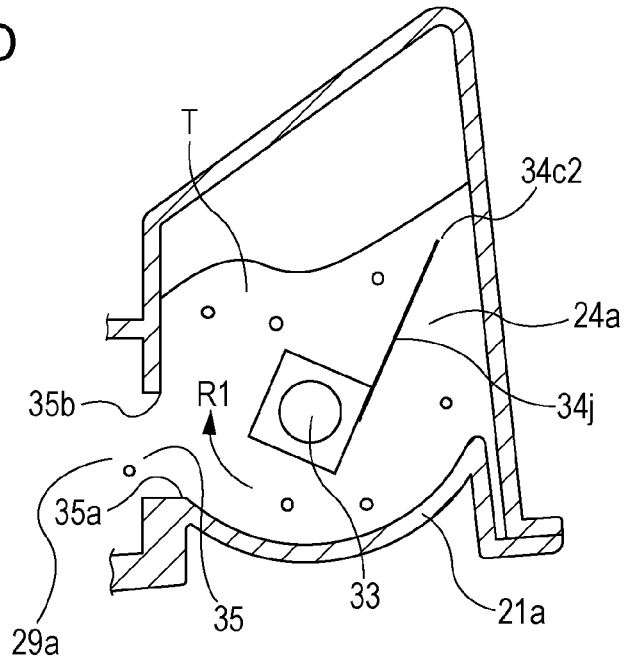
FIG. 5D is a vertical cross-sectional view illustrating a behavior of the first conveying portion according to the first embodiment.

FIG. 4 illustrates a configuration of the developing opening 35 and the elastic sheet 34 and their positional relationship in the longitudinal direction according to the present embodiment.

As illustrated in FIG. 4, the developing opening 35 is an opening that is provided between the developer containing chamber 24*a* and the developing chamber 29*a* (see FIG. 3) to provide communication between the developer containing chamber 24*a* and the developing chamber 29*a*. The developing opening 35 is provided with a connecting part 36 that connects two sides of the developing opening 35 extending in the longitudinal direction. That is, the connecting part 36 connects one end (opening lower end) 35*a* to the other end (opening upper end) 35*b* of the developing opening 35 in a direction orthogonal to the longitudinal direction. In the present embodiment, in particular, the connecting part 36 is formed to extend in the direction orthogonal to the longitudinal direction.

The elastic sheet 34 is divided into a first conveying portion 34*j*, an entering portion 34*a*, and an avoiding portion 34*b* by a slit K that divides the elastic sheet 34. The first conveying portion 34*j* is located in a region not overlapping with the connecting part 36 as viewed in the direction orthogonal to the longitudinal direction. When the shaft member 33 rotates, the first conveying portion 34*j* conveys developer from the developer containing chamber to the developing chamber. The entering portion 34*a* is located in a region overlapping with the connecting part 36 as viewed in the direction orthogonal to the longitudinal direction. When the shaft member 33 rotates, the entering portion 34*a* moves around to the back of the connecting part 36 and enters the developing chamber 29*a*. The avoiding portion 34*b* is a contact portion that comes into contact with the connecting part 36 when the entering portion 34*a* enters the developing chamber 29*a*. The avoiding portion 34*b* has the function of avoiding overall deformation of the elastic sheet 34 even when the elastic sheet 34 comes into contact with the connecting part 36. The configurations of the first conveying portion 34*j*, entering portion 34*a*, and avoiding portion 34*b* will be described in detail later on.

Figure 1:
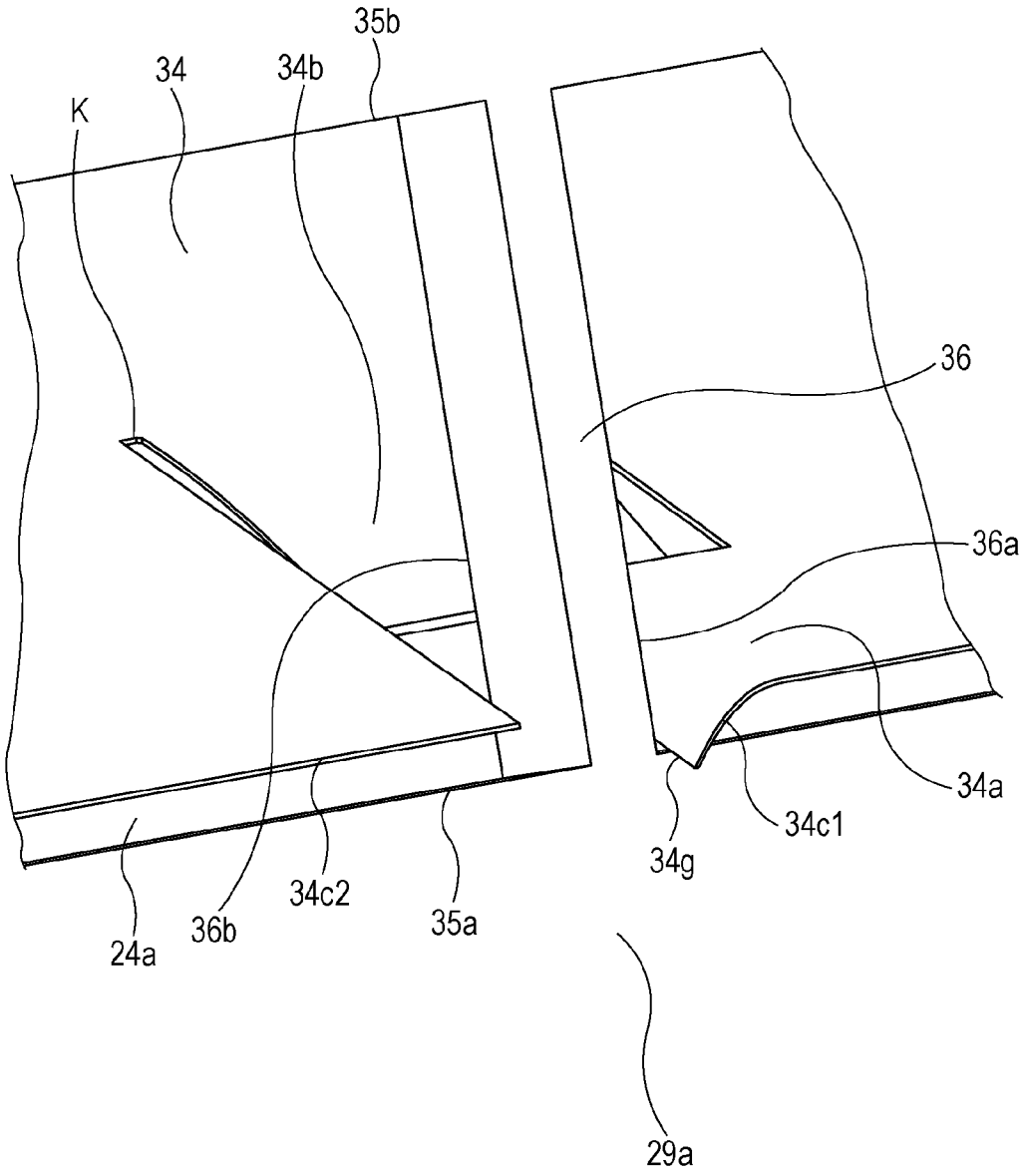
FIG. 1 illustrates a behavior of an entering portion according to a first embodiment.
Figure 6:
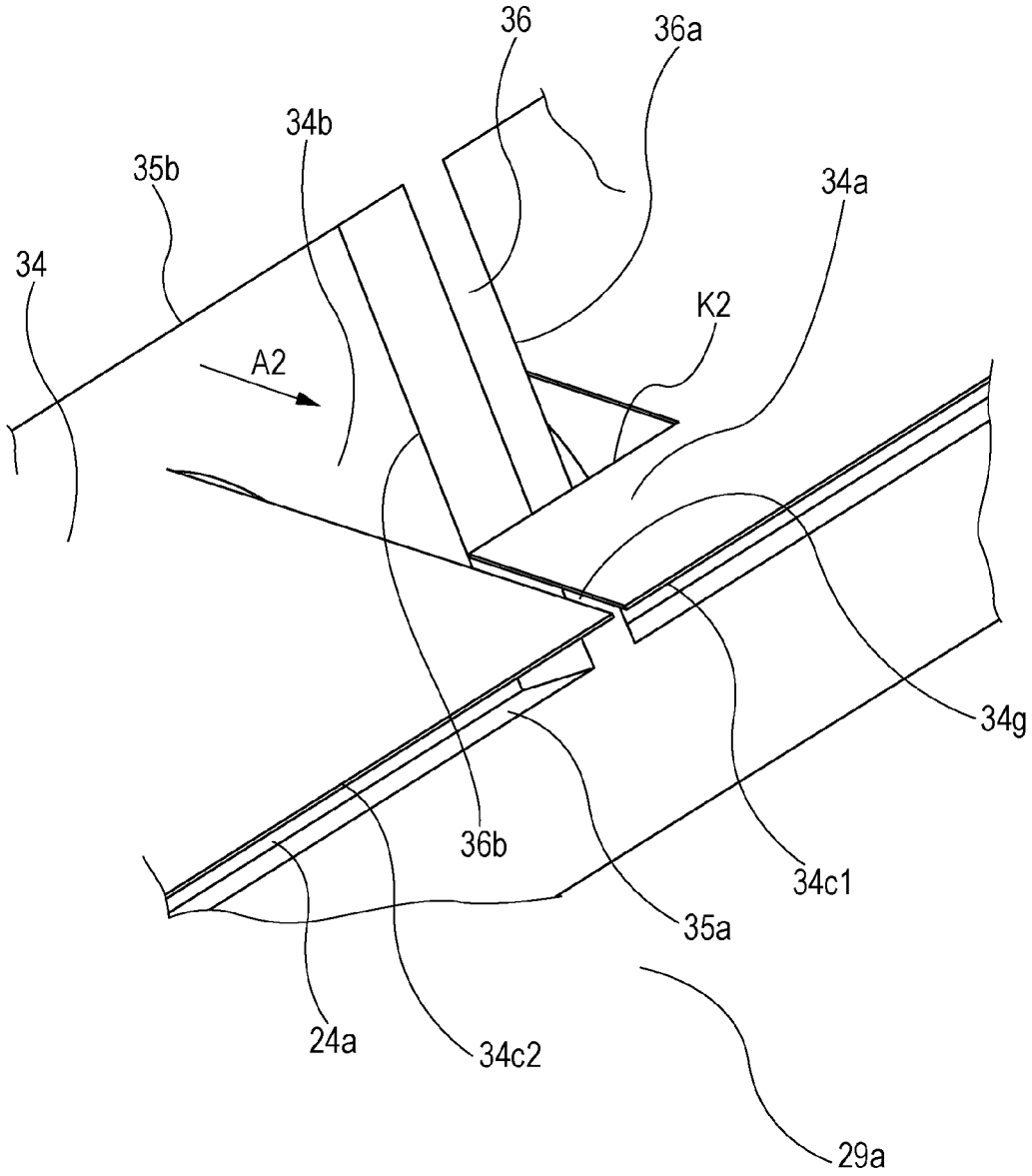
FIG. 6 illustrates a behavior of the entering portion according to the first embodiment.
Figure 7A:
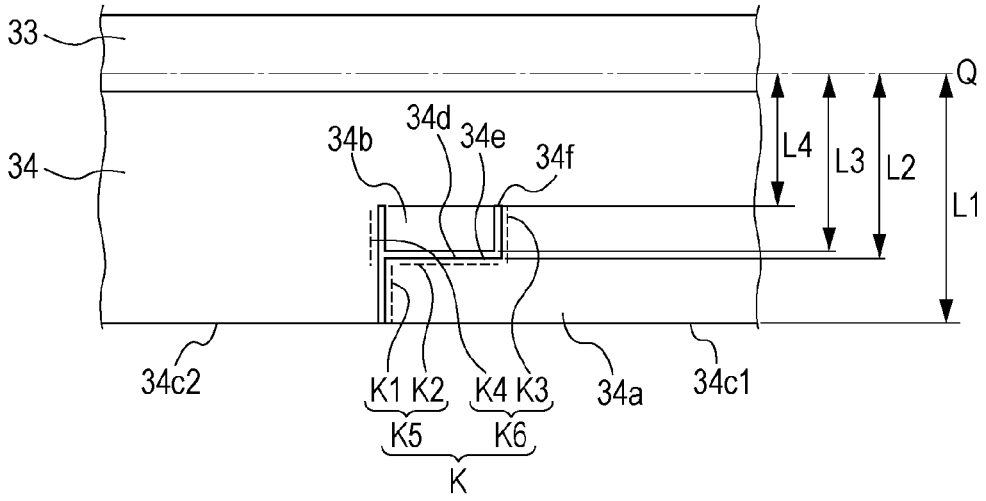
FIG. 7A illustrates a dimensional relationship between the developing opening and the elastic sheet according to the first embodiment.
Figure 7B:
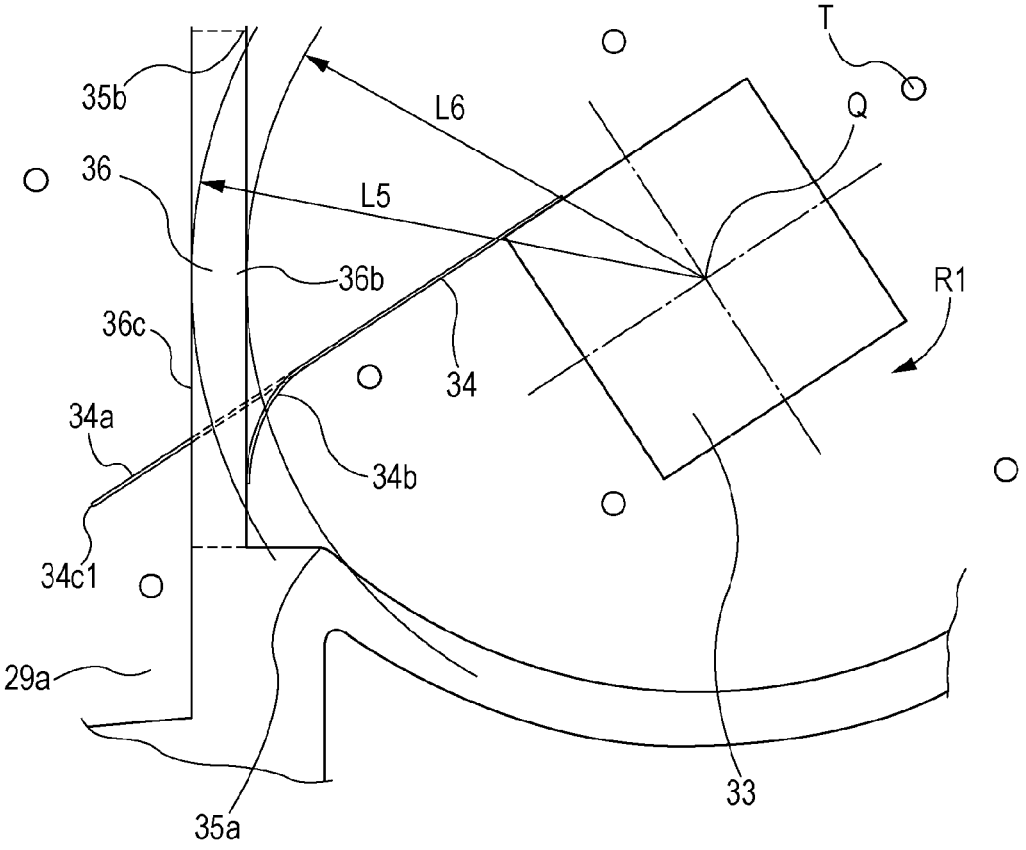
FIG. 7B illustrates a dimensional relationship between the developing opening and the elastic sheet according to the first embodiment.
Figure 8:
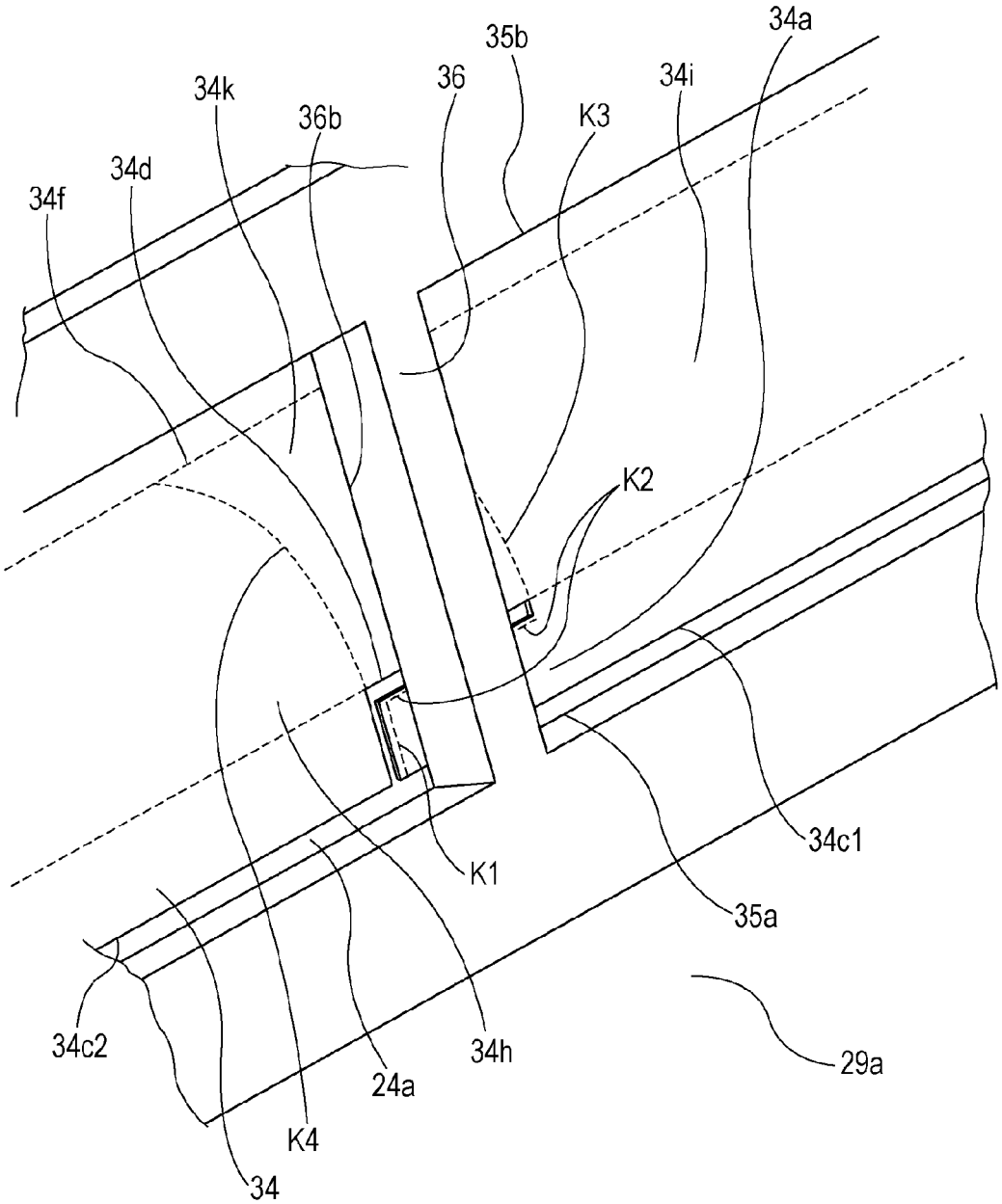
FIG. 8 is a vertical cross-sectional view illustrating a behavior of an avoiding portion according to the first embodiment.

The developing opening 35 and the behavior of the elastic sheet 34 in the present configuration will now be described with reference to FIG. 5A to FIG. 8 and FIG. 1. FIG. 5A to FIG. 5D each are a cross-sectional view taken along line A of FIG. 4. FIG. 5A to FIG. 5D illustrate how the first conveying portion 34*j* behaves with respect to the developing opening 35. Note that the developing roller 22 and the regulating member 23 are not shown in FIG. 5A to FIG. 5D. FIG. 1 and FIG. 6 are perspective views illustrating how the entering portion 34*a* behaves with respect to the developing opening 35. FIG. 7A and FIG. 7B illustrate a dimensional relationship between the elastic sheet 34 and the developing opening 35. FIG. 7A illustrates a dimensional relationship in the elastic sheet 34. FIG. 7B is a cross-sectional view taken along line B of FIG. 4 and illustrates a dimensional relationship in the developing opening 35. Note that the developing roller 22 and the regulating member 23 are not shown in FIG. 7B. FIG. 8 illustrates how the elastic sheet 34 behaves when there is no avoiding portion 34*b*.

A behavior of the first conveying portion 34*j* with respect to the developing opening 35 will be described with reference to FIG. 5A to FIG. 5D. When the shaft member 33 rotates in the direction of arrow R1, the first conveying portion 34*j* moves toward the developing opening 35 as in FIG. 5A while rubbing against the bottom 21*a* of the developer containing chamber 24*a*. After a leading edge (free end) 34*c*2 of the first conveying portion 34*j* passes through the opening lower end 35*a* in the developing opening 35, the first conveying portion 34*j* is released from the deformation and allows the leading edge 34*c*2 to enter the developing chamber 29*a* as in FIG. 5B. When the leading edge 34*c*2 enters the developing chamber 29*a*, it is possible to agitate the toner T in the developing chamber 29*a* and prevent occurrence of toner packing in the developing chamber 29*a*. Then, as in FIG. 5C, when the shaft member 33 further rotates in the direction of arrow R1, the first conveying portion 34*j* comes into contact with the opening upper end 35*b* in the developing opening 35 and moves toward the developer containing chamber 24*a* while being deformed again. After the leading edge 34*c*2 passes through the opening upper end 35*b*, the first conveying portion 34*j* is released from the deformation and returned to the developer containing chamber 24*a* as in FIG. 5D.

By repeating this operation, the toner T in the developer containing chamber 24*a* is conveyed to the developing chamber 29*a*.

Behaviors of the entering portion 34*a* and the avoiding portion 34*b* with respect to the developing opening 35 will now be described with reference to FIG. 1 and FIG. 6 to FIG. 8.

The entering portion 34*a* is characterized in that, from the developer containing chamber 24*a*, the entering portion 34*a* enters a region on the back side of the connecting part 36 when the connecting part 36 is viewed in the direction orthogonal to the longitudinal direction (i.e., in the direction of arrow A2 in FIG. 6). First, as illustrated in FIG. 1, the entering portion 34*a* comes into contact with the connecting part 36 in the vicinity of the opening lower end 35*a*. The entering portion 34*a* begins to deform along a connecting-part side face 36*a*, which is a side face of the connecting part 36 substantially orthogonal to the longitudinal direction. After an end 34*g* of the entering portion 34*a* passes through the connecting-part side face 36*a*, the entering portion 34*a* is released from the deformation as in FIG. 6 and a leading edge 34*c*1 of the entering portion 34*a* enters the developing chamber 29*a*.

As illustrated in FIG. 7A, L1 denotes a distance from a rotation center Q of the shaft member 33 to the leading edges 34*c*1 and 34*c*2, and L2 denotes a distance from the rotation center Q to one end 34*e* of the entering portion 34*a*. As illustrated in FIG. 7B, L5 denotes a distance from the rotation center Q to a connecting-part back face 36*c*, which is a face of the connecting part 36 adjacent to the developing chamber 29*a*. The distances described above are set to satisfy the relationship L1>L2>L5.

Thus, the leading edge 34*c* of the elastic sheet 34 can enter the developing chamber 29*a* in substantially the entire region, including the vicinity of the connecting part 36, in the longitudinal direction. Specifically, both the leading edge 34*c*1 of the entering portion 34*a* and the leading edge 34*c*2 of the first conveying portion 34*j* forming the leading edge 34*c* of the elastic sheet 34 enter the developing chamber 29*a*. Therefore, even when the connecting part 36 is provided, the elastic sheet 34 can perform agitation in the developing chamber 29*a* in substantially the entire region in the longitudinal direction.

For the avoiding portion 34*b*, as illustrated in FIG. 7A, L3 denotes a distance from the rotation center Q of the shaft member 33 to one end 34*d* of the avoiding portion 34*b*, and L4 denotes a distance from the rotation center Q to the other end 34*f* of the avoiding portion 34*b*. As illustrated in FIG. 7B, L6 denotes a distance from the rotation center Q to a connecting-part front face 36*b*, which is a face of the connecting part 36 adjacent to the developer containing chamber 24*a*. The distances described above are set to satisfy the relationship L3>L6>L4.

Thus, the avoiding portion 34*b* comes into contact with the connecting part 36 in the vicinity of the opening lower end 35*a* and begins to deform along the front face 36*b* of the connecting part 36. Even when the entering portion 34*a* enters the developing chamber 29*a*, the avoiding portion 34*b* does not enter the developing chamber 29*a* and continues to travel in the developer containing chamber 24*a* as the shaft member 33 rotates in the direction of arrow R1.

As illustrated in FIG. 7A, the slit K of the elastic sheet 34 is composed of slits K1, K2, K3, and K4.

Note that the slits K1 and K2 that form the entering portion 34*a* are collectively referred to as a first slit K5, and the slits K3 and K4 that form the avoiding portion 34*b* are collectively referred to as a second slit K6.

When the entering portion 34*a* is located on the back of the connecting part 36, the entering portion 34*a* overlaps in position with the connecting part 36 when the entering portion 34*a* and the slit K2 are viewed in the direction orthogonal to the axial direction of the shaft member 33 (i.e., in the direction of arrow A2 in FIG. 6). The slit K2 is positioned to cross the connecting part 36 (see FIG. 4 and FIG. 6). That is, the slit K2 of the first slit K5 is a crossing portion positioned to cross the connecting part 36 as viewed in the direction orthogonal to the longitudinal direction. The slit K2 allows the entering portion 34*a* to enter the back of the connecting part 36.

As illustrated in FIG. 7A, the slit K3 and the slit K4 extend in a direction crossing (i.e., intersecting) the longitudinal direction of the shaft member 33. In other words, the slits K3 and K4 extend from the leading edge 34*d* of the avoiding portion 34*b* toward the shaft member 33. Because of the presence of the slits K3 and K4, the avoiding portion 34*b* in contact with the connecting part 36, as illustrated in FIG. 6, can be significantly bent to the upstream side in the rotation direction of the shaft member 33 (i.e., in the direction indicated by R1 in FIG. 3).

The slits K3 and K4 separate the avoiding portion 34*b* from the first conveying portion 34*j* and the entering portion 34*a*. Therefore, even when the avoiding portion 34*b* is brought into contact with the connecting part 36 and significantly bent, the first conveying portion 34*j* and the entering portion 34*a* are prevented from being significantly deformed. This allows the entering portion 34*a* to reliably enter the back of the connecting part 36. When the entering portion 34*a* enters the back of the connecting part 36 as illustrated in FIG. 6, the avoiding portion 34*b* is bent toward the upstream of the elastic-sheet leading edge (34*c*1 and 34*c*2) in the rotation direction of the shaft member 33.

If the elastic sheet 34 does not have the slits K3 and K4 as illustrated in FIG. 8, a region 34*k* of the elastic sheet 34 in contact with the connecting part 36 is connected to regions 34*i* and 34*h* at both ends thereof. As a result, if the region 34*k* is brought into contact with the front face 36*b* of the connecting part 36 and deformed, the entire elastic sheet 34 is deformed about the fixed end 34*f*. Thus, the entering portion 34*a* is deformed to cause the leading edge 34*c*1 thereof to move toward the developer containing chamber 24*a*. This deformation may hinder the entry of the entering portion 34*a* from the developer containing chamber 24*a* to the developing chamber 29*a*.

In the present embodiment, where the elastic sheet 34 has the slits K3 and K4, a contact portion that is to come into contact with the connecting part 36 is separated from the first conveying portion 34*j* and the entering portion 34*a* to form the avoiding portion 34*b*. When the connecting part 36 comes into contact with the avoiding portion 34*b*, the avoiding portion 34*b* alone is bent toward the upstream side in the rotation direction of the shaft member 33. This avoids deformation of the entering portion 34*a* and facilitates the entry of the entering portion 34*a* to the back of the connecting part 36.

When the shaft member 33 further rotates in the direction of arrow R1 after the entry of the entering portion 34*a* into the developing chamber 29*a*, the entering portion 34*a* comes into contact with the connecting-part side face 36*a* again in the vicinity of the opening upper end 35*b* in the developing opening 35. Then the entering portion 34*a* is returned to the developer containing chamber 24*a* while being deformed in a manner similar to that during passage through the opening lower end 35*a*.

By repeating the series of operations described above, even when the developing opening 35 is provided with the connecting part 36, the elastic sheet 34 can convey the toner T in the developer containing chamber 24*a* to the developing chamber 29*a* and perform agitation in the developing chamber 29*a* including the vicinity of the connecting part 36. Thus, it is possible to prevent the occurrence of toner packing in the developing chamber 29*a* and prevent the toner T from remaining around the connecting part 36.

Second Embodiment

The developing device 20 according to a second embodiment will now be described. A basic configuration of the developing device and a configuration of the image forming apparatus that includes the developing device are the same as those of the first embodiment described above. Therefore, components having the same functions as those in the first embodiment are given the same reference numerals to omit their description, and only differences from the first embodiment will be described here.

Figure 9:
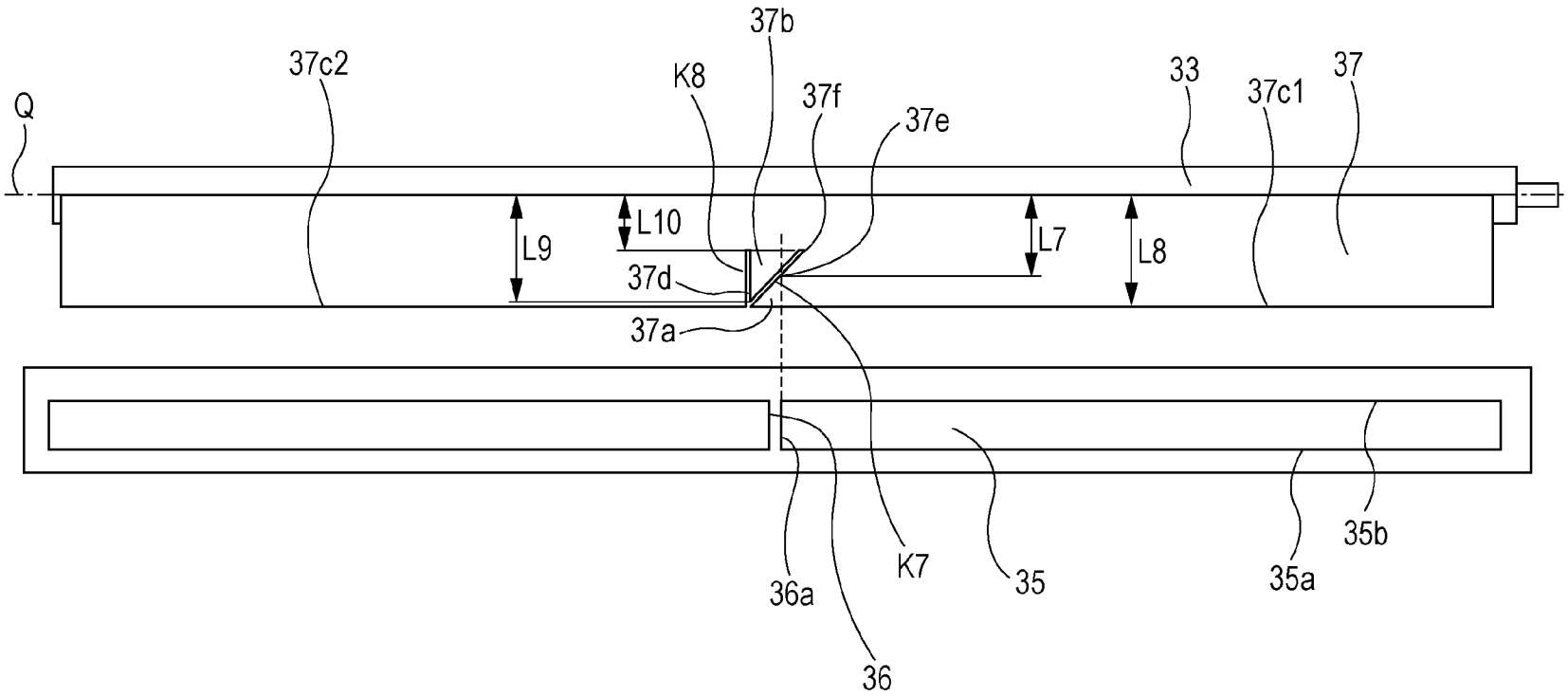
FIG. 9 is a schematic view of the developing opening and an elastic sheet according to a second embodiment.

FIG. 9 illustrates a configuration of the developing opening 35 and an elastic sheet 37 and their positional relationship according to the second embodiment. In the elastic sheet 37 of the present embodiment, an entering portion 37*a* and an avoiding portion 37*b* are separated by a slit K7 that extends from a free end of the elastic sheet 37 at an angle with respect to the connecting part 36. The slit K7, which is a first slit in the present embodiment, extends in a direction crossing the connecting part 36 to form the entering portion 37*a*. A slit K8 is a second slit that forms the avoiding portion (contact portion) 37*b*.

Similarly to the first embodiment, the relationship L8>L7>L5 needs to be satisfied, where L8 is a distance from the rotation center Q of the shaft member 33 to an elastic-sheet leading edge 37*c*, L7 is a distance from the rotation center Q to an intersection point 37*e* of the side face 36*a* of the connecting part 36 and the elastic sheet 37, and L5 (see FIG. 7B) is a distance from the rotation center Q to the connecting-part back face 36*c*.

Thus, the entering portion 37*a* has a plane crossing the connecting part 36 in the longitudinal direction and is configured to satisfy the relationship L8>L7>L5. The entering portion 37*a* may be of another shape, as long as this relationship is satisfied.

On the other hand, the slit K8 extends from a leading edge of the avoiding portion (contact portion) 37*b* toward the shaft member 33. Again, similarly to the first embodiment, the relationship L9>L6>L10 needs to be satisfied, where L9 is a distance from the rotation center Q to one end 37*d* of the avoiding portion 37*b*, L10 is a distance from the rotation center Q to the other end 37*f* of the avoiding portion 37*b*, and L6 (see FIG. 7B) is a distance from the rotation center Q to the connecting-part front face 36*b*.

When the avoiding portion 37*b* comes into contact with the connecting part 36, the slit K8 allows the avoiding portion 37*b* to bend to the upstream side in the rotation direction of the shaft member 33. This can prevent deformation of elastic-sheet leading edges 37*c*1 and 37*c*2. The avoiding portion 37*b* may be of another shape, as long as it is configured to satisfy the relationship L9>L6>L10.

With the present configuration, as in the first embodiment, even when the developing opening 35 has the connecting part 36 for increased strength, the entering portion 37*a* can move around to the back of the connecting part 36 and enter the developing chamber 29*a*. The entering portion 37*a* can convey the toner in the developer containing chamber 24*a* to the developing chamber 29*a* and perform agitation in the developing chamber 29*a* in substantially the entire longitudinal region, including the vicinity of the connecting part 36. Thus, it is possible to prevent the toner T from remaining around the connecting part 36 and prevent the occurrence of toner packing in the developing chamber 29*a*.

Third Embodiment

The developing device 20 according to a third embodiment will now be described. A basic configuration of the developing device and a configuration of the image forming apparatus that includes the developing device are the same as those of the first embodiment described above. Therefore, components having the same functions as those in the first embodiment are given the same reference numerals to omit their description, and only differences from the first embodiment will be described here.

Figure 10:
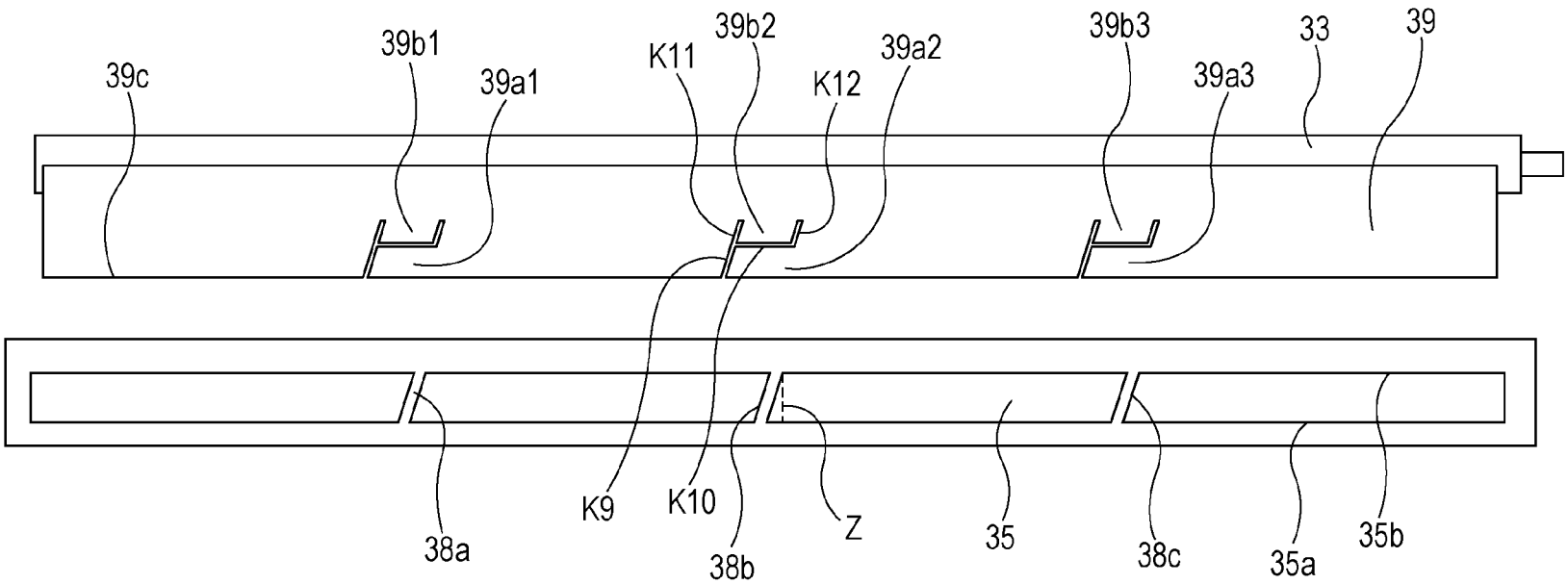
FIG. 10 is a schematic view of the developing opening and an elastic sheet according to a third embodiment.

FIG. 10 illustrates a configuration of the developing opening 35 and an elastic sheet 39 and their positional relationship in the longitudinal direction according to the third embodiment. In the present embodiment, the developing opening 35 is provided with a plurality of connecting parts 38*a*, 38*b*, and 38*c*, which correspond to entering portions 39*a*1, 39*a*2, and 39*a*3 and avoiding portions 39*b*1, 39*b*2, and 39*b*3, respectively, of the elastic sheet 39. Unlike the first embodiment, the connecting parts 38*a*, 38*b*, and 38*c* are at an angle with respect to a straight line Z that vertically connects the opening lower end 35*a* to the opening upper end 35*b*.

As described above, the number of connecting parts 38 for the developing opening 35 does not have to be one, and a plurality of connecting parts 38 may be provided depending on the area to be reinforced or the need for reinforcement. In this case, the elastic sheet 39 has a plurality of entering portions 39*a* and avoiding portions 39*b* corresponding to the connecting parts 38, so that the elastic sheet 39 can move beyond the connecting parts 38 in substantially the entire longitudinal region, as in the first embodiment.

The connecting parts 38 that connect opposite ends of the developing opening 35 do not necessarily have to be formed perpendicularly to the longitudinal direction as in the first embodiment. That is, as in the present embodiment, the connecting parts 38 may be formed at an angle with respect to the longitudinal direction, as long as they are configured to connect one end to the other end of the developing opening 35 in the direction orthogonal to the longitudinal direction.

In the present embodiment, the elastic sheet 39 is provided with slits K9, K10, K11, and K12. The slits K9 and K10 form a first slit that defines each entering portion 39*a*. In the present embodiment, the slit K10 is formed in a direction crossing the corresponding connecting part 38 in accordance with the inclination of the connecting part 38. That is, the slit K10 is a crossing portion of the first slit that crosses the connecting part 38.

The slits K11 and K12 form a second slit that defines each avoiding portion 39*b*.

As in the first embodiment, each entering portion 39*a* can move around to the back of the corresponding connecting part 38 and enter the developing chamber 29*a*.

Each avoiding portion 39*b* serves as a contact portion that comes into contact with the corresponding connecting part 38 in the developer containing chamber. As in the first embodiment, the avoiding portions 39*b* serve to prevent the entire elastic sheet from being bent when the elastic sheet comes into contact with the connecting parts 38.

Fourth Embodiment

The developing device 20 according to a fourth embodiment will now be described. A basic configuration of the developing device and a configuration of the image forming apparatus that includes the developing device are the same as those of the first embodiment described above. Therefore, components having the same functions as those in the first embodiment are given the same reference numerals to omit their description, and only differences from the first embodiment will be described here.

Figure 11:
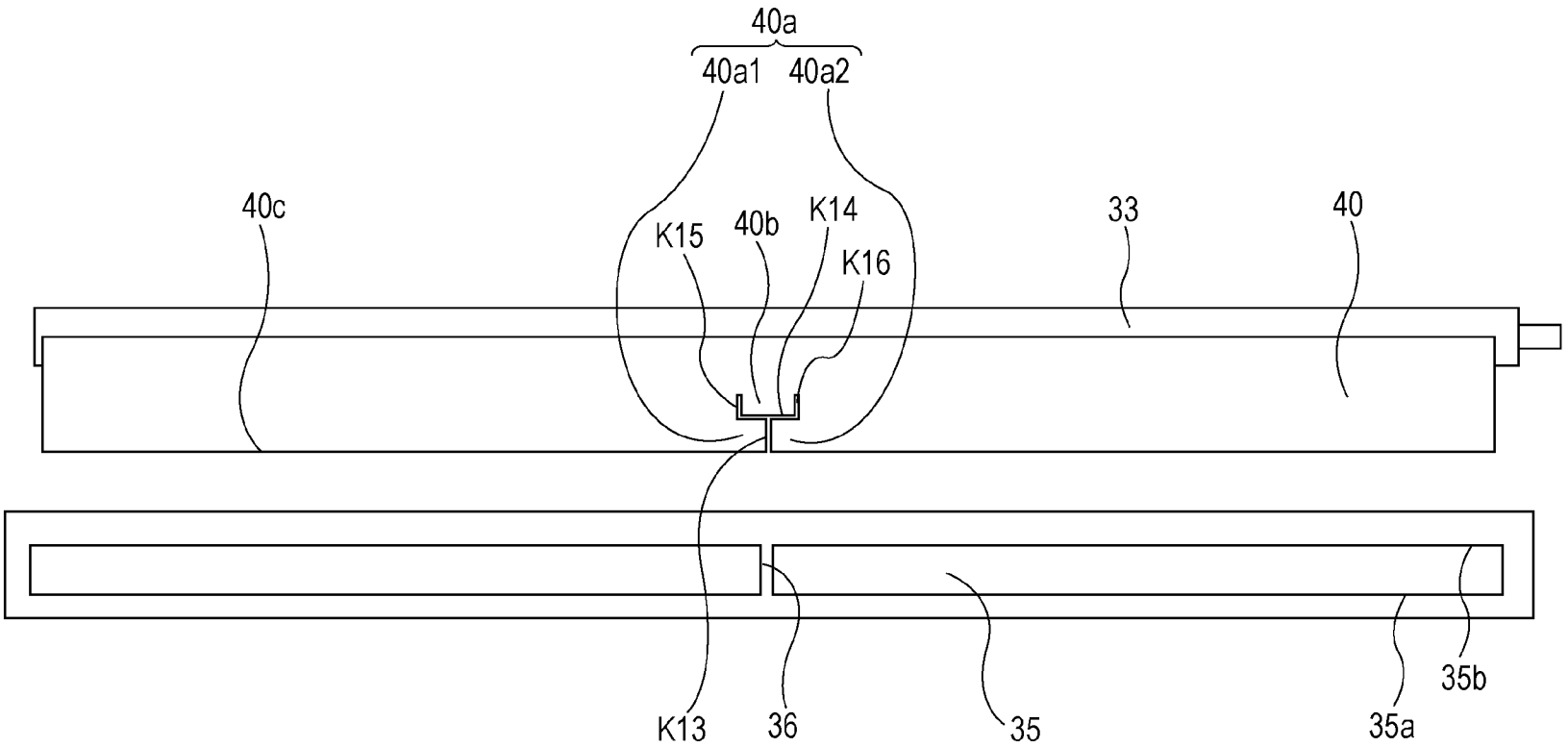
FIG. 11 is a schematic view of the developing opening and an elastic sheet according to a fourth embodiment.

FIG. 11 illustrates a configuration of the developing opening 35 and an elastic sheet 40 and their positional relationship in the longitudinal direction according to the fourth embodiment. In the present embodiment, the elastic sheet 40 is provided with slits K13, K14, K15, and K16. The slits K13 and K14 form a first slit that defines entering portions 40*a*1 and 40*a*2. The slits K15 and K16 form a second slit that defines an avoiding portion 40*b*.

In the present embodiment, the first slit (K13 and K14) forms a T shape. Specifically, the slit K13 extends from a free end of the elastic sheet 40 in a direction crossing the longitudinal direction, whereas the slit K14 extends in two different directions from the slit K13. Thus, two entering portions 40*a*1 and 40*a*2 are provided for one connecting part 36.

By providing a plurality of entering portions for one connecting part 36, toner can be conveyed and agitated more effectively.

Fifth Embodiment

The developing device 20 according to a fifth embodiment will now be described. A basic configuration of the developing device and a configuration of the image forming apparatus that includes the developing device are the same as those of the first embodiment described above. Therefore, components having the same functions as those in the first embodiment are given the same reference numerals to omit their description, and only differences from the first embodiment will be described here.

Figure 12:
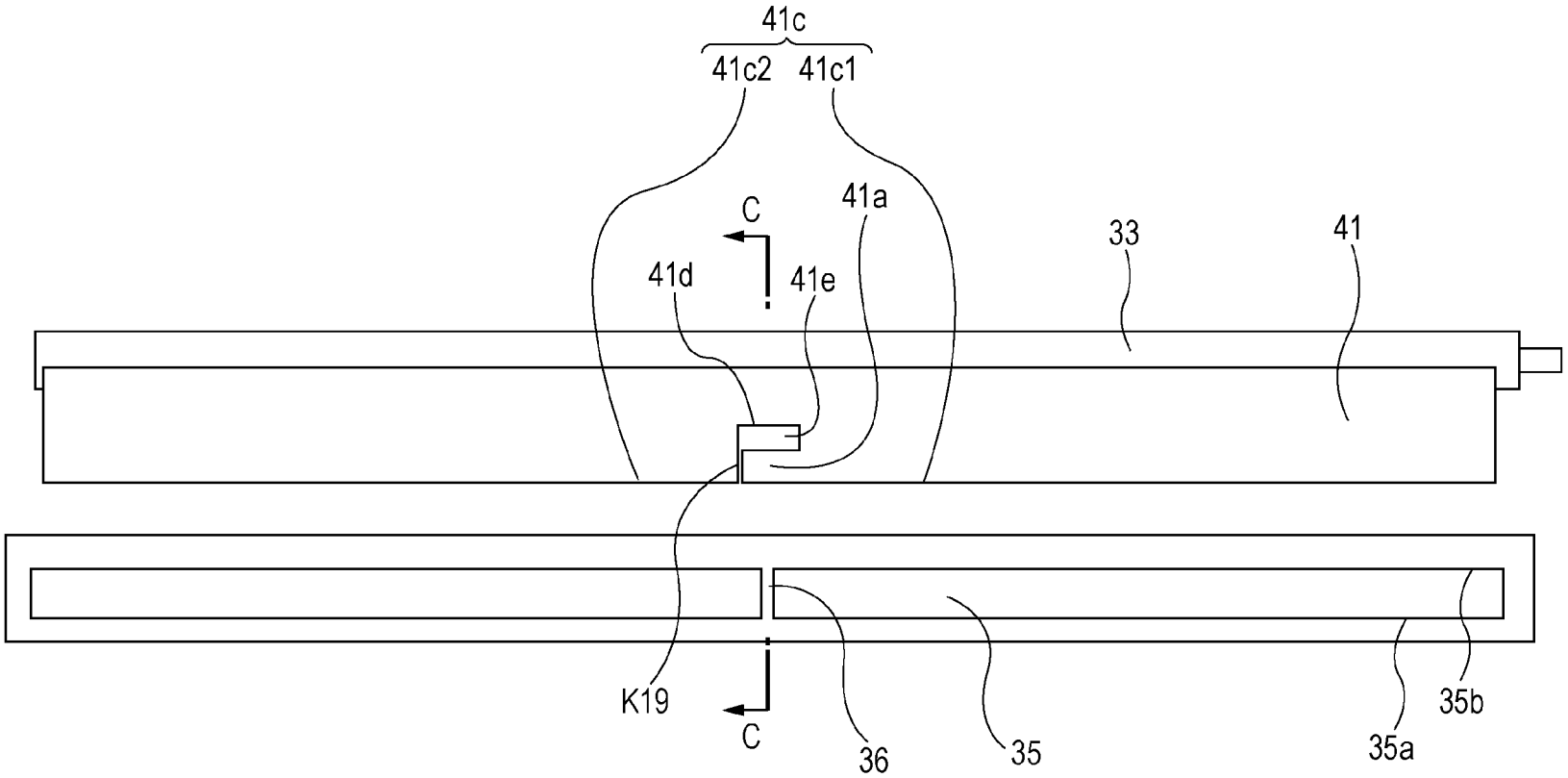
FIG. 12 is a schematic view of the developing opening and an elastic sheet according to a fifth embodiment.
Figure 13:
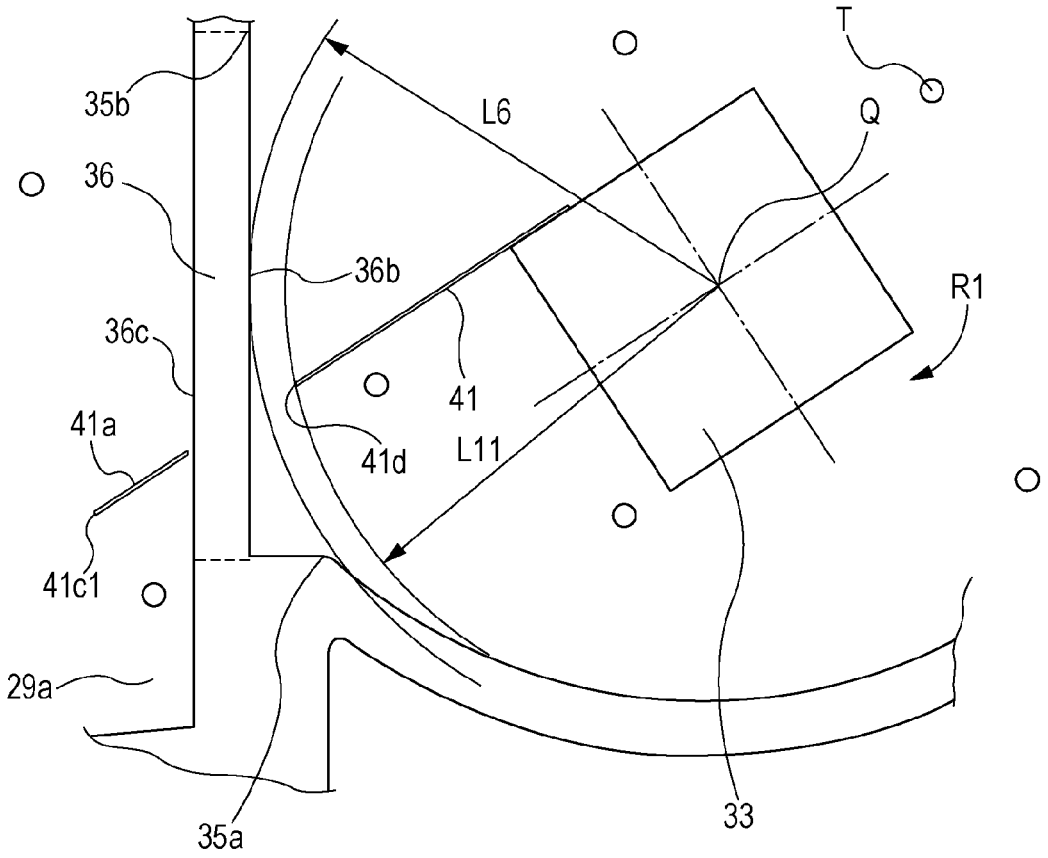
FIG. 13 illustrates a dimensional relationship between the developing opening and the elastic sheet according to the fifth embodiment.

FIG. 12 illustrates a configuration of the developing opening 35 and an elastic sheet 41 and their positional relationship in the longitudinal direction according to the fifth embodiment. FIG. 13 is a cross-sectional view taken along line C of FIG. 12 and illustrates a positional relationship between the elastic sheet 41 and the developing opening 35.

As illustrated in FIG. 12, instead of having the avoiding portion 34*b* (see FIG. 4) of the first embodiment, the elastic sheet 41 of the present embodiment has an opening portion (sheet opening) 41*e* formed by cutting the elastic sheet 41 to avoid contact of the connecting part 36 with the elastic sheet 41. In this case, as illustrated in FIG. 13, the relationship L11<L6 needs to be satisfied, where L11 is a distance from the rotation center Q of the shaft member 33 to one end 41*d* of the opening portion 41*e*, and L6 is a distance from the rotation center Q to the connecting-part front face 36*b*.

When an entering portion 41*a* of the elastic sheet 41 enters the developing chamber 29*a*, the elastic sheet 41 does not come into contact with the connecting part 36 in any region other than the entering portion 41*a*. Therefore, a leading edge 41*c* (41*c*1 and 41*c*2) of the elastic sheet 41 is not moved toward the developer containing chamber 24*a* by deformation. Thus, the entering portion 41*a* can reliably enter the developing chamber 29*a*.

In the present embodiment, a slit K19 extends from a free end of the elastic sheet 41 to communicate with the opening portion 41*e*. The slit K19 and the opening portion 41*e* form a first slit that defines the entering portion 41*a*. The opening portion 41*e* is a crossing portion formed in a direction crossing the connecting part 36.

It is possible to realize smooth toner conveyance even when the opening of the developer containing chamber is provided with the connecting part.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2011/078436, filed Dec. 8, 2011, which is hereby incorporated by reference herein in its entirety.

The invention claimed is:

1. A developer containing chamber that contains a developer, comprising:

an outlet opening configured for the developer to pass therethrough;

a shaft member rotatably supported inside the developer containing chamber;

a sheet member secured to the shaft member and configured to convey the developer from the outlet opening to outside of the developer containing chamber when the shaft member rotates; and a connecting part configured to connect one end to another end of the outlet opening and divide the outlet opening into a plurality of openings, wherein the sheet member has an entering portion formed by a first slit extending from a free end of the sheet member, and wherein the entering portion is configured to enter the outside of the developer containing chamber from the inside of the developer containing chamber, and the entering portion, when the entering portion enters the outside of the developer containing chamber, is configured to be in a position overlapping with the connecting part as viewed from the inside to the outside of the developer containing chamber through the outlet opening along a direction orthogonal to a longitudinal direction of the shaft member.

2. The developer containing chamber according to claim 1, wherein the sheet member has a contact portion formed by a second slit extending in a direction crossing the longitudinal direction, the contact portion configured to contact the connecting part inside the developer containing chamber and bend toward an upstream of the free end of the sheet member in a rotation direction of the shaft member when the entering portion enters the outside of the developer containing chamber.

3. The developer containing chamber according to claim 1, wherein the sheet member has a sheet opening not contacting the connecting part inside the developer containing chamber when the entering portion enters the outside of the developer containing chamber.

4. The developer containing chamber according to claim 1, wherein the entering portion contacts the connecting part and deforms to enter the outside of the developer containing chamber.

5. The developer containing chamber according to claim 1, wherein after extending from the free end of the sheet member in a direction crossing the longitudinal direction of the shaft member, the first slit extends in two different directions to form two entering portions.

6. A developing device that develops a latent image formed on an image bearing member, comprising:

a developer bearing member configured to bear a developer;

a developing chamber configured to include the developer bearing member;

a developer containing chamber configured to contain the developer;

an outlet opening configured to provide communication between the developing chamber and the developer containing chamber;

a shaft member rotatably supported inside the developer containing chamber;

a sheet member secured to the shaft member and configured to convey the developer from the developer containing chamber to the developing chamber when the shaft member rotates; and a connecting part configured to connect one end to another end of the outlet opening and divide the outlet opening into a plurality of openings, wherein the sheet member has an entering portion formed by a first slit extending from a free end of the sheet member, and wherein the entering portion is configured to enter the developing chamber from the developer containing chamber, and, when the entering portion enters the outside of the developer containing chamber, is configured to be in a position overlapping with the connecting part as viewed from the inside to the outside of the developer containing chamber through the outlet opening along a direction orthogonal to a longitudinal direction of the shaft member.

7. The developing device according to claim 6, wherein the sheet member has a contact portion formed by a second slit extending in a direction crossing the longitudinal direction, the contact portion configured to contact the connecting part inside the developer containing chamber and bend toward an upstream of the free end of the sheet member in a rotation direction of the shaft member when the entering portion enters the developing chamber.

8. The developing device according to claim 6, wherein the sheet member has a sheet opening not contacting the connecting part inside the developer containing chamber when the entering portion enters the developing chamber.

9. The developing device according to claim 6, wherein the entering portion contacts the connecting part and deforms to enter the developing chamber.

10. The developing device according to claim 6, wherein after extending from the free end of the sheet member in a direction crossing the longitudinal direction of the shaft member, the first slit extends in two different directions to form two entering portions.

11. A process cartridge to be attached to, or removed from, an image forming apparatus main body, comprising:

an image bearing member on which a latent image is formed;

a developer bearing member configured to bear a developer for developing the latent image;

a developing chamber configured to include the developer bearing member;

a developer containing chamber configured to contain the developer;

an outlet opening configured to provide communication between the developing chamber and the developer containing chamber;

a shaft member rotatably supported inside the developer containing chamber;

a sheet member secured to the shaft member and configured to convey the developer from the developer containing chamber to the developing chamber when the shaft member rotates; and a connecting part configured to connect one end to another end of the outlet opening and divide the outlet opening into a plurality of openings, wherein the sheet member has an entering portion formed by a first slit extending from a free end of the sheet member, and wherein the entering portion is configured to enter the developing chamber from the developer containing chamber, and, when the entering portion enters the outside of the developer containing chamber, is configured to be in a position overlapping with the connecting part as viewed from the inside to the outside of the developer containing chamber through the outlet opening along a direction orthogonal to a longitudinal direction of the shaft member.

12. The process cartridge according to claim 11, wherein the sheet member has a contact portion formed by a second slit extending in a direction crossing the longitudinal direction, the contact portion configured to contact the connecting part inside the developer containing chamber and bend toward an upstream of the free end of the sheet member in a rotation direction of the shaft member when the entering portion enters the developing chamber.

13. The process cartridge according to claim 11, wherein the sheet member has a sheet opening not contacting the connecting part inside the developer containing chamber when the entering portion enters the developing chamber.

14. The process cartridge according to claim 11, wherein the entering portion contacts the connecting part and deforms to enter the developing chamber.

15. The process cartridge according to claim 11, wherein after extending from the free end of the sheet member in a direction crossing the longitudinal direction of the shaft member, the first slit extends in two different directions to form two entering portions.

16. An image forming apparatus that forms an image on a recording medium, comprising:

conveying means for conveying the recording medium;

an image bearing member on which a latent image is formed;

a developer bearing member configured to bear a developer for developing the latent image;

a developing chamber configured to include the developer bearing member;

a developer containing chamber configured to contain the developer;

an outlet opening configured to provide communication between the developing chamber and the developer containing chamber;

a shaft member rotatably supported inside the developer containing chamber;

a sheet member secured to the shaft member and configured to convey the developer from the developer containing chamber to the developing chamber when the shaft member rotates; and a connecting part configured to connect one end to another end of the outlet opening and divide the outlet opening into a plurality of openings, wherein the sheet member has an entering portion formed by a first slit extending from a free end of the sheet member, and wherein the entering portion is configured to enter the developing chamber from the developer containing chamber, and, when the entering portion enters the outside of the developer containing chamber, is configured to be in a position overlapping with the connecting part as viewed from the inside to the outside of the developer containing chamber through the outlet opening along a direction orthogonal to a longitudinal direction of the shaft member.

* * * * *